US007434869B2

(12) United States Patent
Murakami

(10) Patent No.: US 7,434,869 B2
(45) Date of Patent: Oct. 14, 2008

(54) CONSTRUCTION MACHINE

(75) Inventor: Yoshiaki Murakami, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 75 days.

(21) Appl. No.: 11/457,945

(22) Filed: Jul. 17, 2006

(65) Prior Publication Data

US 2007/0035160 A1 Feb. 15, 2007

(30) Foreign Application Priority Data

Aug. 12, 2005 (JP) ..... 2005-233939

(51) Int. Cl.
*B62D 33/06* (2006.01)

(52) U.S. Cl. ..... 296/190.03; 296/205; 180/89.12

(58) Field of Classification Search ..... 296/190.01, 296/190.03, 203.01, 205; 180/89.12; 280/756, 280/784

See application file for complete search history.

(56) References Cited

U.S. PATENT DOCUMENTS

2004/0104060 A1* 6/2004 Mori et al. ..... 180/89.12
2004/0237353 A1 12/2004 Okunishi et al.
2005/0000121 A1* 1/2005 Mori ..... 37/347
2005/0006157 A1* 1/2005 Shioji et al ..... 180/89.13
2006/0017308 A1 1/2006 Kojima et al.
2006/0125287 A1* 6/2006 Fornell et al. ..... 296/190.03
2006/0226680 A1* 10/2006 Matsumoto et al. .... 296/190.01
2006/0249986 A1* 11/2006 Yoon ..... 296/190.03
2006/0273234 A1* 12/2006 Yoon ..... 248/562
2007/0018484 A1* 1/2007 Lee ..... 296/190.08
2007/0018555 A1* 1/2007 Lee ..... 313/402
2007/0024088 A1* 2/2007 Mori et al. ..... 296/190.08
2007/0132277 A1* 6/2007 Ishii et al. ..... 296/190.01
2007/0187991 A1* 8/2007 Mori ..... 296/187.12

FOREIGN PATENT DOCUMENTS

JP 2001-123482 5/2001
JP 2002-327462 11/2002

* cited by examiner

*Primary Examiner*—Jason S Morrow
(74) *Attorney, Agent, or Firm*—Oblon, Spivak, McClelland, Maier & Neustadt, P.C.

(57) ABSTRACT

With this construction machine, a lateral load applied to a right rear pillar of a cabin in construction machine rollover or the like is transmitted to a left rear pillar via a load-transmitting beam which is inclined downwardly to the right, and is received by a vertical rib of a center section constituting an upper frame. In addition, a short-column auxiliary pillar is provided in front of the right rear pillar and is connected to the right rear pillar with a connector so as to support the lateral load.

6 Claims, 5 Drawing Sheets

CONSTRUCTION MACHINE

BACKGROUND OF THE INVENTION

1. Field of the Invention

The present invention relates to construction machines such as hydraulic excavators provided with cabins.

2. Description of the Related Art

A cabin frame 12 constituting a cabin 4 shown in FIG. 6 is composed of front pillars 13 and 14 disposed on the left and right, respectively, rear pillars 15 and 16 disposed on the left and right, respectively, a center pillar 17 disposed on the left and between the front pillar 13 and the rear pillar 15, a left roof member 18 disposed on the left and spanning the upper ends of the front pillar 13 and the rear pillar 15, a right roof member 19 disposed on the right and spanning the upper ends of the front pillar 14 and the rear pillar 16, an upper front cross member 20 spanning the upper ends of the left front pillar 13 and the right front pillar 14, and an upper rear cross member 21 spanning the upper ends of the left rear pillar 15 and the right rear pillar 16.

The cabin frame 12 may receive loads which are generally classified as a load F1 received from the left in machine rollover (turnover) or the like (hereinafter, referred to as a lateral load), a load F2 received from the rear (similarly, referred to as a rear load), and a load F3 received vertically from the upper portion to the lower portion (similarly, referred to as a vertical load).

Accordingly, in view of ensuring safety for the operator, it is required to ensure the existence of a space for the operator, particularly, a rear space where the operator is located, even if the cabin frame 12 is deformed due to these loads.

To meet this requirement, the cabin frame 12 employs a configuration including a front gate structure composed of the front pillars 13 and 14 and the upper front cross member 20, and a rear gate structure composed of the rear pillars 15 and 16 and the upper rear cross member 21, the front and rear gate structures being connected to each other with the roof members 18 and 19.

In addition, there have been suggested as a method of reinforcing the cabin frame 12, various configurations such as a configuration in which wide pillars extending from the intermediate portions in the front-back direction of both the left and right sides toward the upper rear are added (refer to Japanese Unexamined Patent Application Publication No. 2002-327462), and a configuration in which front and rear gate structures are connected to each other with a platy roof member (refer to Japanese Unexamined Patent Application Publication No. 2001-123482).

The cabin frame 12 that supports the loads only with the gate structures may not sufficiently provide a supporting capability against the lateral, rear and vertical loads F1, F2, and F3.

Meanwhile, when the reinforcement is added to the configuration in addition to the gate structures, the reinforced structure may have to be large in order to obtain a high reinforcing effect, resulting in problems such as a considerable increase in the weight of the cabin frame, or a degradation in the field of view of the cabin.

However, a technique in which a relatively small-scale reinforcement is added, for instance, merely connecting the left and right rear pillars 15 and 16 with a beam, may not provide a sufficient reinforcing effect.

SUMMARY OF THE INVENTION

It is an object of the present invention to provide a construction machine provided with a cabin with a markedly increased a load-supporting capability against a rollover or the like while avoiding the problems associated with known reinforced structures.

A construction machine according to an aspect of the present invention includes the following basic configuration.

That is, the construction machine includes: a lower traveling body; an upper rotating body rotatably mounted on the lower traveling body and provided with an upper frame; and a cabin mounted on the upper rotating body, in which the upper frame includes a center section to which a work device is attached, and a deck for attaching the cabin, the deck provided in a one side direction relative to the center section. The center section has a vertical rib substantially vertically erected on at least a side adjacent to the deck and facing the one side direction. The cabin has a cabin frame as a framework composed of front pillars on both the left and right in the front portion, rear pillars on both the left and right in the rear portion, and a center pillar between the front pillar and the rear pillar in the one side direction, the rear pillar in the other side direction opposite to the one side direction abutting on the vertical rib of the center section so as to transmit a lateral load, which is applied in the other side direction, to the vertical rib, while a load-transmitting beam is provided between the rear pillars on both the left and right so as to transmit the lateral load, which is applied in the other side direction to the rear pillar on the side facing the one side direction, to the rear pillar on the side facing the other side direction.

With this configuration, by featuring the vertical rib, the lateral load is transmitted to the vertical rib via the load-transmitting beam and the rear pillar in the other side direction, and is received by the vertical rib. Accordingly, a supporting capability against the lateral load can be remarkably increased, and in particular, a deformation-suppressing effect of the cabin in the left-right direction can be increased.

DESCRIPTION OF THE PREFERRED EMBODIMENTS

An embodiment of the present invention will be described below with reference to FIGS. 1 to 4.

Figure 5:
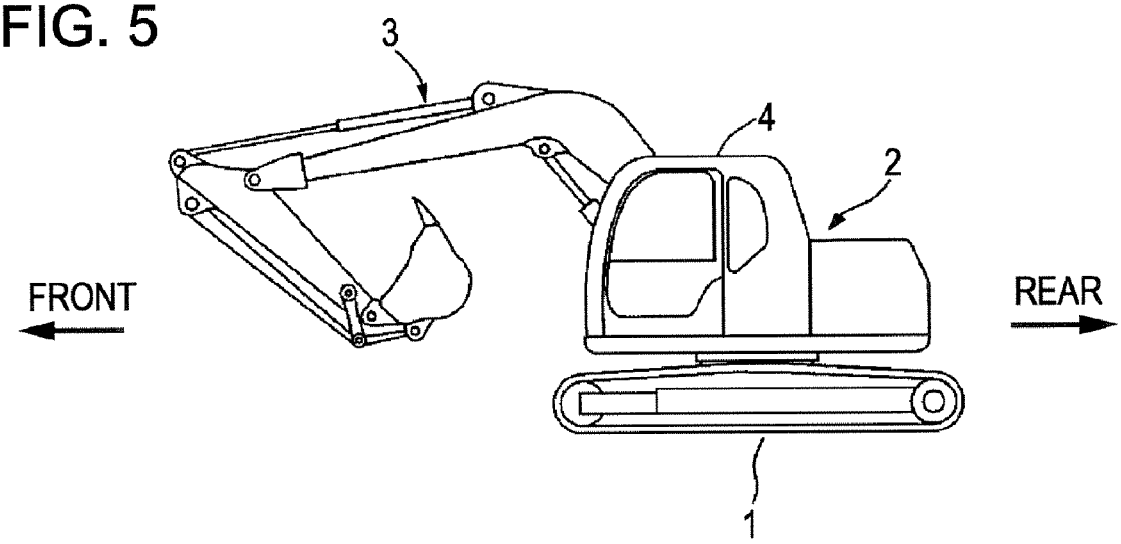
FIG. 5 is a schematic side elevational view showing a hydraulic excavator.

Herein, a cabin of a hydraulic excavator exemplifies a cabin of a construction machine. As shown in FIG. 5, the hydraulic excavator includes a crawler-type lower traveling body 1, an upper rotating body 2 mounted on the lower traveling body 1, and a work attachment (work device) 3 attached to the upper rotating body 2. A cabin 4 is provided at the upper rotating body 2.

Figure 6:
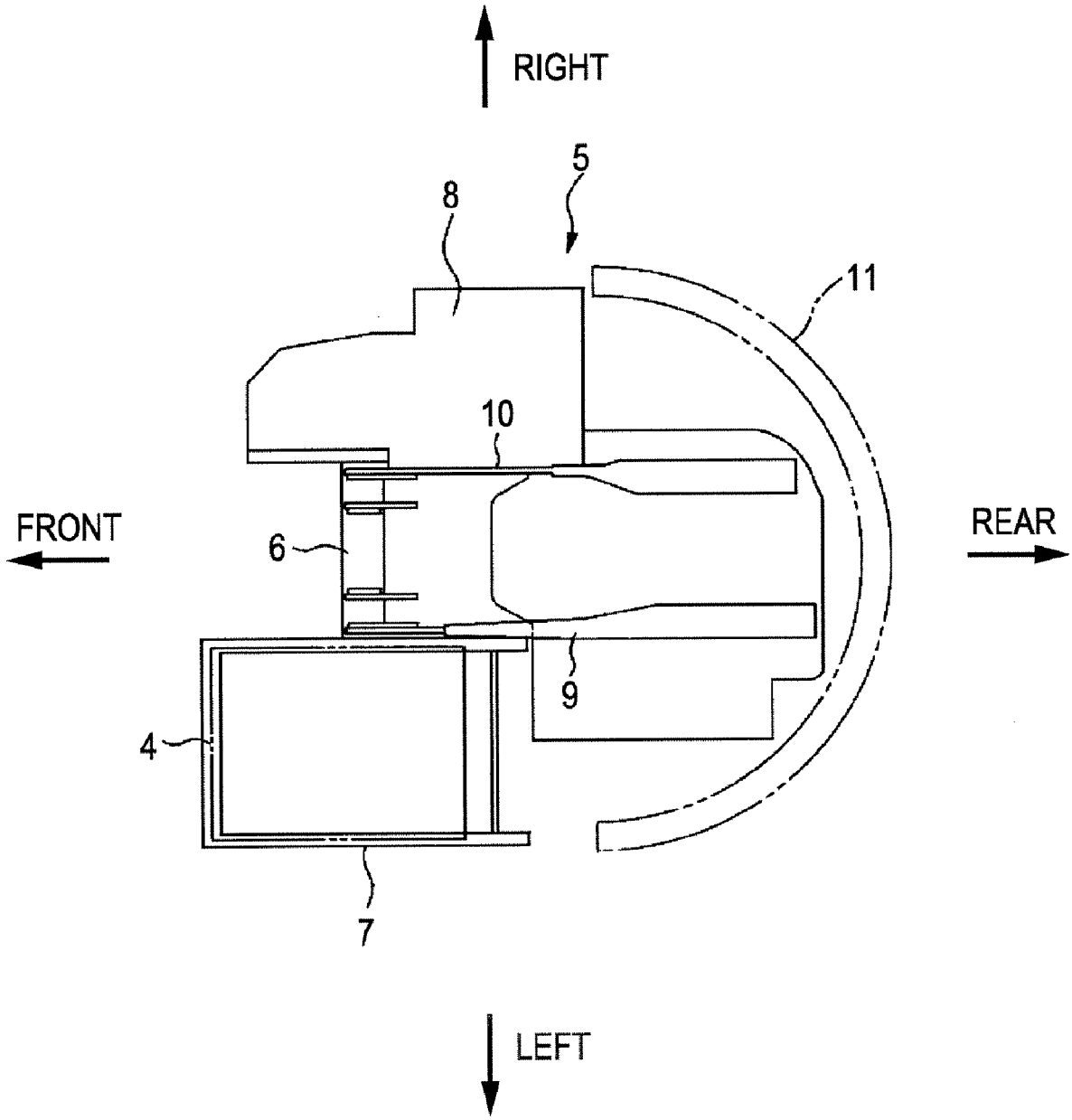
FIG. 6 is a plan view showing an upper frame of the hydraulic excavator of FIG. 5.
Figure 7:
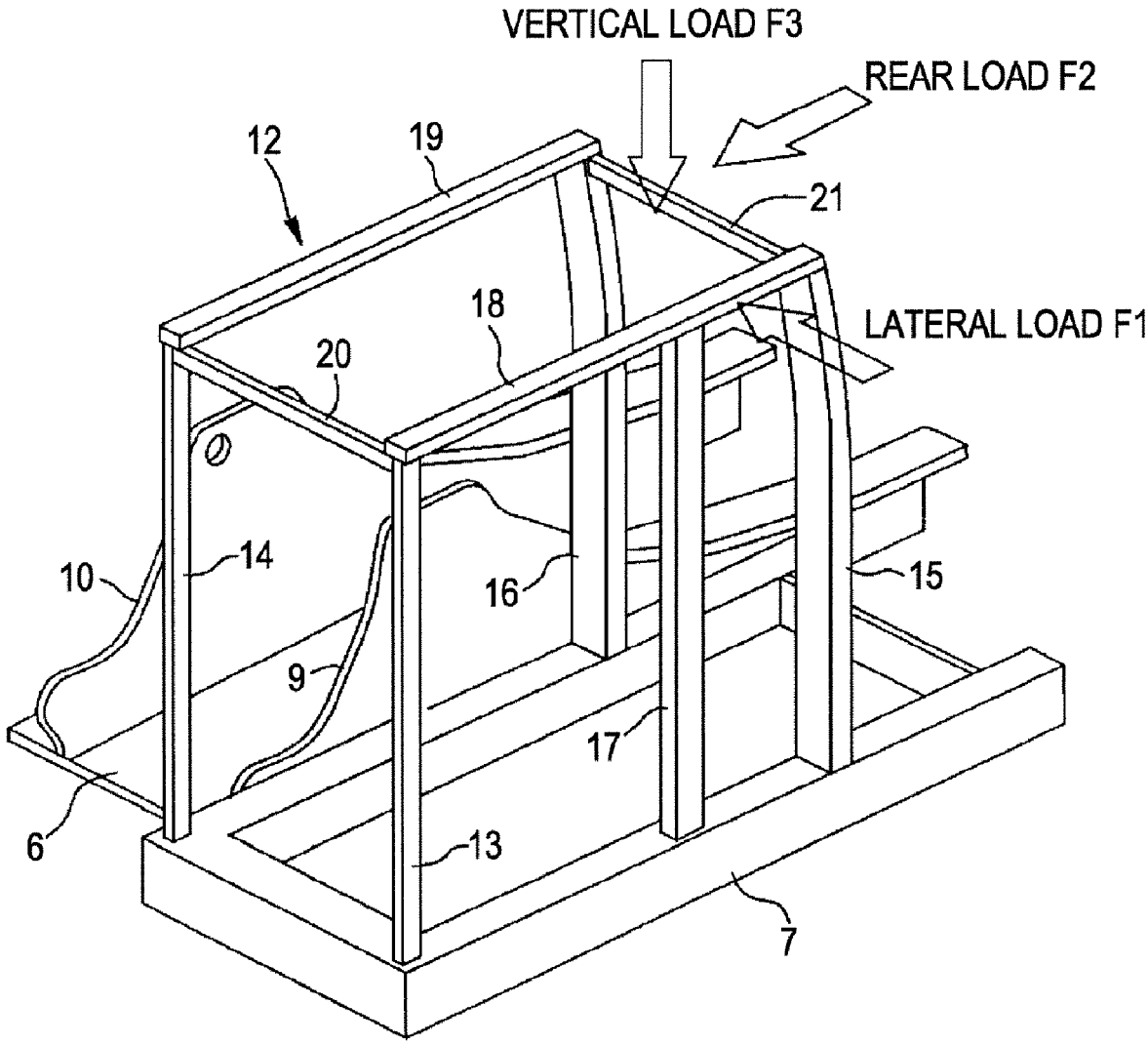
FIG. 7 RELATED ART
FIG. 7 is a perspective view showing a cabin frame according to the related art.

Next, the configuration of an upper frame 5 is shown in FIG. 6 as a main body of the upper rotating body 2. Note that only the minimum frame components as required are shown here for simplification of the drawing. The upper frame 5 is composed of a center section 6, a left side deck 7, on which the cabin 4 is mounted, on the left of the center section 6 (left as viewed from an operator sitting in the cabin 4; the same viewpoint will be applied to the following orientations of right, front and rear), and a right side deck 8, on which various devices are mounted, on the right.

Note that while the deck 8 for attaching the cabin is provided on the left of the center section 6 in this embodiment, the deck 8 is only required to be on one side of the center section 6, and may not be on the left. That is, since the present invention is configured to provide the cabin 4 which can remarkably increase a load-supporting capability against the rollover if the cabin 4 is involved to the rollover to either the left or right side, in a case where the cabin is oppositely located, the deck 8 might be provided on the right of the center section 6 in this embodiment.

The center section 6 is provided with vertical ribs 9 and 10 vertically erected on both the left and right. The work attachment 3 shown in FIG. 5 is attached to the front portions of the vertical ribs 9 and 10, while a counterweight 11 is mounted on the rear portions thereof.

Figure 1:
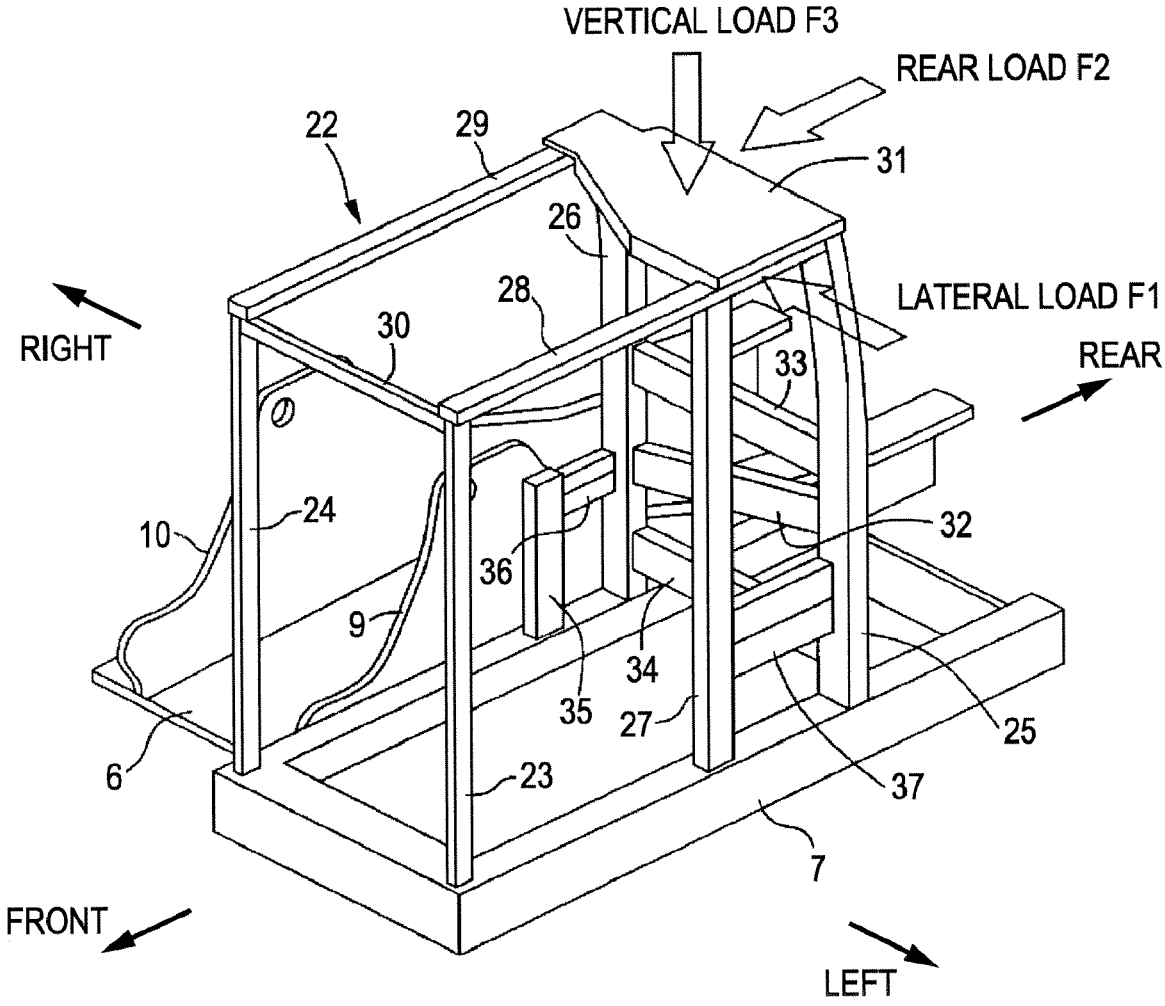
FIG. 1 is a perspective view showing a cabin frame according to an embodiment of the present invention.

The cabin 4 is so formed that exterior parts (panels, windowpanes for front, rear, left and right windows, and the like) are attached to a cabin frame 22 configured as a framework shown in FIG. 1.

Note that while FIG. 1 shows that pillars 23 to 27 (described later) of the cabin frame 22 are directly erected on the left side deck 7 for simplification of the drawing, a floor plate is actually attached at the left side deck 7 via a vibration-absorbing mount, and then the pillars 23 to 27 are erected on the floor plate.

Incidentally, in this embodiment, the left side deck 7 is provided on the left (one side direction) of the center section 6 of the upper frame, and the cabin is mounted on the left side deck 7. In addition, the vertical ribs 9 and 10 are vertically provided on both the left and right of the center section 6. Note that the right represents the other side direction while the left represents the one side direction.

The cabin frame 22 of the cabin according to the embodiment includes left and right front pillars 23 and 24, left and right rear pillars 25 and 26, a center pillar 27, left and right roof members 28 and 29, and front and rear cross members 30 and 31. The cabin frame 22 has a basic configuration in which gate structures are configured on the front and rear sides of the cabin frame 22, and the both gate configurations are connected to each other with the roof members 28 and 29.

The rear cross member 31 is formed by a plate (thick plate or thin plate with the periphery thereof bent) as shown in the drawing, and spans between the rear portions of the left and right roof members 28 and 29.

As a first feature in the cabin frame 22, a load-transmitting beam 32 is provided between the left and right rear pillars 25 and 26.

The load-transmitting beam 32 is formed by a frame member having an angular U-shaped cross section (or a square pipe or the like), and is attached between the left and right rear pillars 25 and 26 so as to be downwardly inclined toward the right as shown in the drawing. In other words, the load-transmitting beam 32 is attached as an inclined beam downwardly toward the right such that the right end of the load-transmitting beam 32 faces the vertical rib 9 on the left of the center section 6, whereas the left end of the load-transmitting beam 32 is connected to the left rear pillar 25 at a position slightly higher than that of the right end.

Herein, a horizontal overhang 9*a* (see FIGS. 3 and 4) is integrally provided at the upper end of the left vertical rib 9, the right end of the load-transmitting beam 32 being connected to the right rear pillar 26 at the height of the overhang 9*a*.

Figure 3:
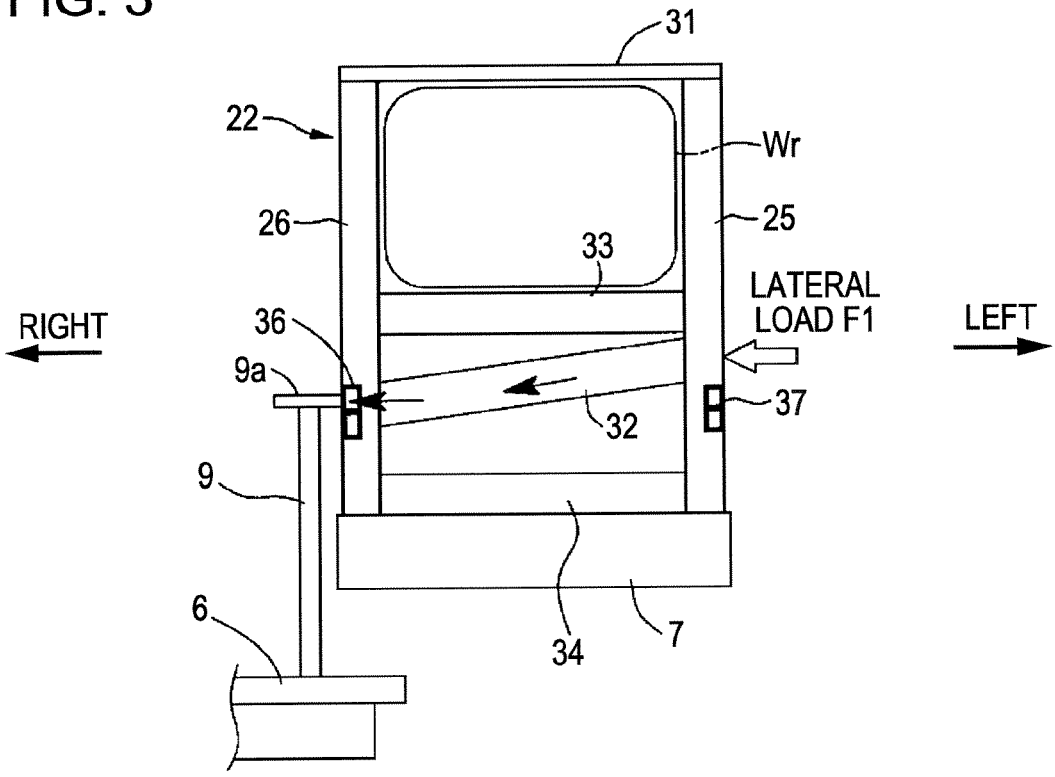
FIG. 3 is a cross sectional view taken along line III-III of FIG. 2.

In addition, as shown in FIG. 3, the right rear pillar 26 is erected on the left side deck 7 to abut on the overhang 9*a* of the left vertical rib 9.

Further, as shown in FIG. 3, the load-transmitting beam 32 is provided to be located completely below a rear window Wr.

Figure 4:
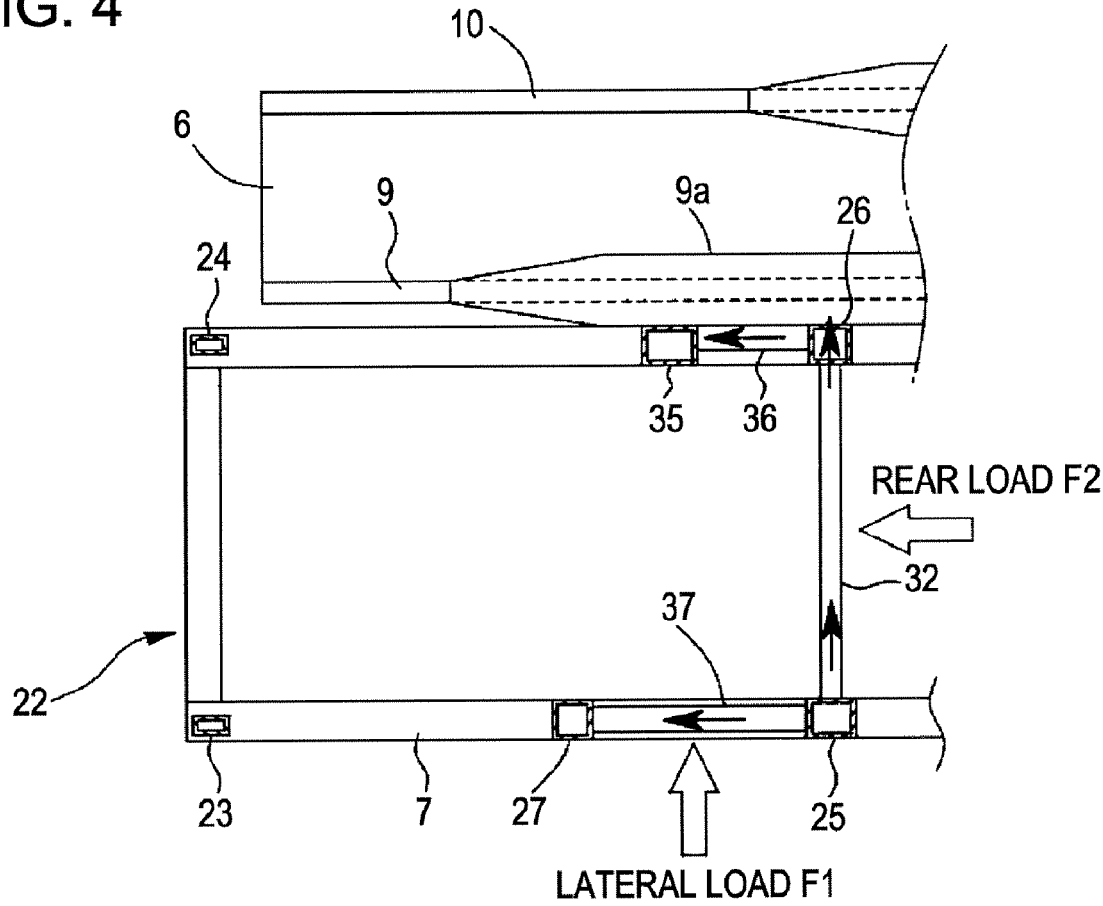
FIG. 4 is a cross sectional view taken along line IV-IV of FIG. 2.

With the configuration of the first feature, as shown in FIGS. 3 and 4, the lateral load F1, which is applied to the left rear pillar 25 in machine rollover, is transmitted to the right rear pillar 26 via the load-transmitting beam 32, and is then received by the left vertical rib 9.

The left vertical rib 9 is formed highly rigid and intense due to the attachment of the work attachment and the counterweight as described above, thereby reliably supporting the lateral load F1.

Owing to this, the supporting capability of the cabin frame 22 against the lateral load F1 is remarkably increased, and especially, the deformation in the left-right direction of the cabin in machine rollover can effectively be suppressed.

In this case, in consideration of that the lateral load F1 is probably applied to a portion in the middle or higher in the height direction of the left rear pillar 25, the load-transmitting beam 32 is attached to the left rear pillar 25 with a position of the left end of the load-transmitting beam 32 being higher than that of the right end, so as to be downwardly inclined toward the right. Accordingly, the lateral load F1 can be transmitted to the left vertical rib 9 effectively.

In addition, since the load-transmitting beam 32 is an inclined beam, the width and weight of the load-transmitting beam 32 may be minimized as required.

Therefore, the cabin can meet the requirement for lightweight, and ensure a field of view of the rear because of the arranging the load-transmitting beam 32 below the rear window Wr.

Incidentally, in this embodiment, horizontal beams 33 and 34 are provided either above and below the load-transmitting beam 32 for reinforcing purposes against the lateral load. However, these may be provided as required.

Next, as a second feature, a short-column auxiliary pillar 35 shorter than the right rear pillar 26 is erected in front of the right rear pillar 26. The auxiliary pillar 35 is connected to the lower portion of the right rear pillar 26 with a horizontal connector 36.

Figure 2:
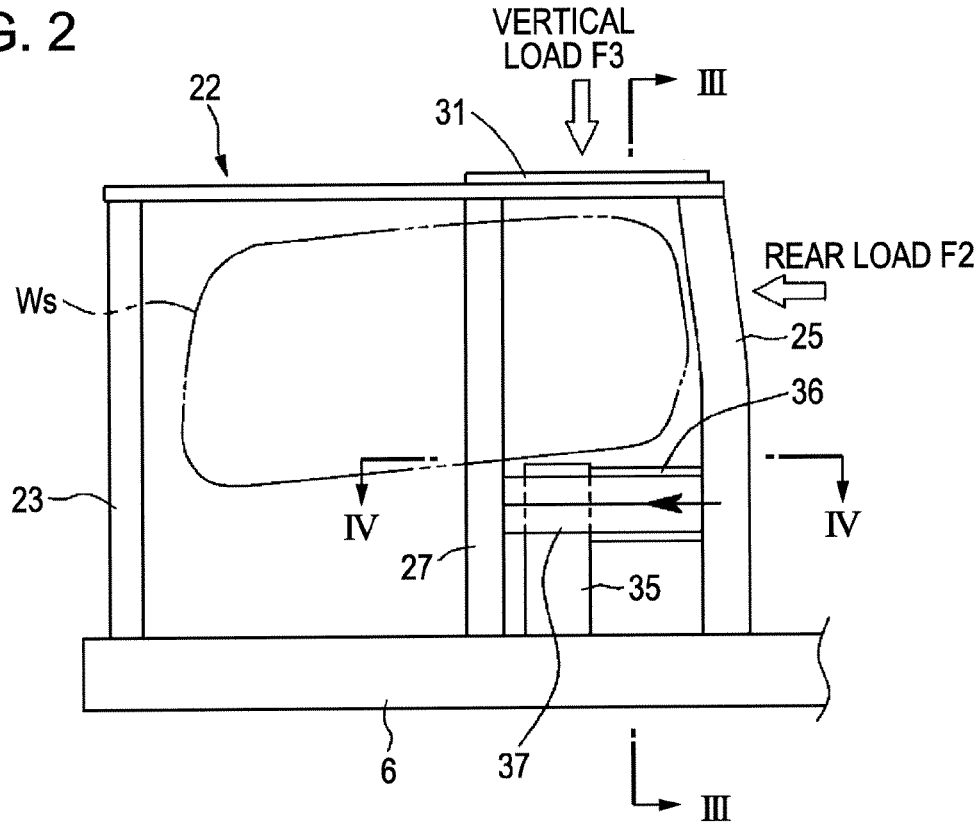
FIG. 2 is a side elevational view of FIG. 1.

As shown in FIG. 2, the auxiliary pillar 35 has a height not interfering with a right side window Ws for ensuring a certain field of view of the right.

In addition, as shown in FIGS. 3 and 4, the connector 36 is provided so as to abut on the left vertical rib 9 (overhang 9*a*) in a manner capable of transmitting the load.

Incidentally, in this embodiment, the connector 36 is so formed that flat square pipes are vertically laminated and connected as shown in the drawing for making the connector 36 be highly rigid and intense. It is obvious that a single square pipe, section bar, or the like may be alternatively used for the connector 36 as long as the necessary rigidity and intensity are secured.

With the configuration of the second feature, the rear load F2 applied to the right rear pillar 26 (including the load component acts forward due to the vertical load F3) is transmitted to the auxiliary pillar 35 via the connector 36, and is supported thereby. Accordingly, a rear-load-carrying capability can be increased at the right portion of the cabin.

In addition, the auxiliary pillar 35 is a short column, thereby not interfering with the field of view of the right for the rear side window Ws.

Further, since the connector 36 is provided to abut on the vertical rib 9 of the center section 6 in a manner capable of transmitting the load, the lateral load F1 can be transmitted to the vertical rib 9 even via the connector 36. Accordingly, the lateral-load-carrying capability can be further increased.

As a third feature, a left reinforce beam 37 spans between the lower portions of the left rear pillar 25 and the center pillar 27.

The provision of the left reinforce beam 37 suppresses the twisting of the left rear pillar 25 caused by the lateral load F1, so that the rear load F2 can be supported even by the center pillar 27.

The left reinforce beam 37 is also so formed that square pipes are vertically laminated and connected for increasing the rigidity and intensity of the left reinforce beam 37 similarly to the connector 36 on the right. However, a single square pipe or the like may be alternatively used.

With the first to third featured configurations, as their combined effects, the load-supporting capability of the cabin against the loads F1, F2 and F3 in the respective directions remarkably increases, and the deformation of the cabin in the respective directions, especially, the deformation of the rear part of the cabin is suppressed, so that the operator can be protected reliably in machine rollover or the like.

Incidentally, according to the configuration with the first feature, the load-transmitting beam 32 is preferably the inclined beam as in the above-described embodiment in view of effectively transmitting the lateral load as much as possible to the vertical rib 9 with the narrow and light beam. It is obvious that a wide pipe, section bar, panel, or the like which has a large surface area may be alternatively provided as the load-transmitting beam as required.

Although the invention has been described with reference to the preferred embodiments in the attached figures, it is noted that equivalents may be employed and substitutions made herein without departing from the scope of the invention as recited in the claims.

What is claimed is:

1. A construction machine comprising:

a lower traveling body;

an upper rotating body rotatably mounted on the lower traveling body and provided with an upper frame; and a cabin mounted on the upper rotating body, wherein the upper frame includes a center section to which a work device is attached, and a deck for attaching the cabin, the deck provided in a one side direction relative to the center section, the center section has a vertical rib substantially vertically erected on at least a side adjacent to the deck and facing the one side direction, and the cabin has a cabin frame as a framework composed of front pillars on both the left and right in the front portion, rear pillars on both the left and right in the rear portion, and a center pillar between the front pillar and the rear pillar on the side facing the one side direction, the rear pillar in the other side direction opposite to the one side direction abutting on the vertical rib of the center section at an abutting vertical height position of the rib, which vertical height position is above the deck, so as to transmit a lateral load, which is applied in the other side direction, to the vertical rib, while a load-transmitting beam being provided between the rear pillars on both the left and right so as to transmit the lateral load, which is applied in the other side direction to the rear pillar on the side facing the one side direction, to the rear pillar on the side facing the other side directions, wherein one end in the other side direction of the load-transmitting beam is at the abutting vertical height position of the vertical rib so as to face the vertical rib at the abutting vertical height position, while another end in the one side direction thereof is connected to the rear pillar in the one side direction at a position higher than that of the one end in the other side direction.

2. A construction machine comprising:

a lower traveling body;

an upper rotating body rotatably mounted on the lower traveling body and provided with an upper frame; and a cabin mounted on the upper rotating body, wherein the upper frame includes a center section to which a work device is attached, and a deck for attaching the cabin, the deck provided in a one side relative to the center section, and the cabin has a cabin frame as a framework composed of front pillars on both the left and right in the front portion, rear pillars on both the left and right in the rear portion, a center pillar between the front pillar and the rear pillar on the left, and an auxiliary pillar in front of the rear pillar on the right and being shorter than that rear pillar, the rear pillar on the right and the auxiliary pillar being connected to each other with a connector, wherein the connector abuts on a vertical rib of the center section so as to transmit the load.

3. A construction machine comprising:

a lower traveling body;

an upper rotating body rotatably mounted on the lower traveling body and provided with an upper frame; and a cabin mounted on the upper rotating body, wherein the upper frame includes a center section to which a work device is attached, and a deck for attaching the cabin, the deck provided in a one side direction relative to the center section, the center section has a vertical rib substantially vertically erected on at least a side adjacent to the deck and facing the one side direction, and the construction machine includes the following features:

(A) the cabin having a cabin frame as a framework composed of front pillars on both the left and right in the front portion, rear pillars on both the left and right in the rear portion, and a center pillar between the front and rear pillars on the side facing the one side direction;

(B) the rear pillar in the other side direction opposite to the one side direction abutting on the vertical rib of the center section so as to transmit a lateral load, which is applied in the other side direction, to the vertical rib, while a load-transmitting beam being provided between the rear pillars on both the left and right so as to transmit the lateral load, which is applied in the other side direction to the rear pillar on the side facing the one side direction, to the rear pillar on the side facing the other side direction;

(C) one end in the other side direction of the load-transmitting beam facing the vertical rib of the center section, while another end in the one side direction thereof being connected to the rear pillar in the one side direction at a position higher than that of the one end in the other side direction; and (D) an auxiliary pillar being provided in front of the rear pillar in the other side direction and being shorter than that rear pillar, the rear pillar in the other side direction and the auxiliary pillar being connected to each other with a connector, wherein the connector abuts on a vertical rib of the center section so as to transmit the load.

4. The construction machine according to claim 1, further comprising a reinforce beam on the side facing the one side direction, the reinforce beam spanning the lower portions of the rear pillar on the side facing the one side direction and the center pillar.

5. The construction machine according to claim 2, further comprising a reinforce beam on the side facing the one side direction, the reinforce beam spanning the lower portions of the rear pillar on the left and the center pillar.

6. The construction machine according to claim 3, further comprising a reinforce beam on the side facing the one side direction, the reinforce beam spanning the lower portions of the rear pillar on the side facing the one side direction and the center pillar.

* * * * *